US007104208B2

(12) United States Patent
Waterfield

(10) Patent No.: US 7,104,208 B2
(45) Date of Patent: Sep. 12, 2006

(54) HARDANGER MACHINE EMBROIDERY AND METHOD

(76) Inventor: Laura M. Waterfield, 11706 Teal Hollow La., Tomball, TX (US) 77377

( * ) Notice: Subject to any disclaimer, the term of this patent is extended or adjusted under 35 U.S.C. 154(b) by 0 days.

(21) Appl. No.: 11/079,577

(22) Filed: Mar. 14, 2005

(65) Prior Publication Data

US 2005/0229831 A1 Oct. 20, 2005

Related U.S. Application Data

(60) Provisional application No. 60/553,179, filed on Mar. 15, 2004.

(51) Int. Cl.
*D05C 17/00* (2006.01)

(52) U.S. Cl. ..... 112/475.18; 112/439

(58) Field of Classification Search ..... 112/475.18, 112/439, 410, 411, 420, 78, 475.17, 475.22, 112/475.23

See application file for complete search history.

(56) References Cited

U.S. PATENT DOCUMENTS

| | | | | | |
|---|---|---|---|---|---|
| 358,156 | A | * | 2/1887 | Juncker | 112/403 |
| 385,772 | A | | 7/1888 | Owen | |
| 399,182 | A | | 3/1889 | Campbell | |
| 466,566 | A | * | 1/1892 | Jenny | 112/438 |
| 823,421 | A | | 6/1906 | Loeb | |
| 865,640 | A | * | 9/1907 | Haberer | 112/475.18 |
| 889,614 | A | | 6/1908 | Johnsen | |
| 924,795 | A | | 6/1909 | Klemm | |
| 1,203,561 | A | | 11/1916 | Aaron | |
| 2,141,560 | A | | 12/1938 | Rudnick | |
| 2,365,315 | A | * | 12/1944 | Williams | 112/439 |
| 3,040,332 | A | | 6/1962 | Kleinwald | |
| 3,377,678 | A | * | 4/1968 | Moriya | 28/164 |

(Continued)

OTHER PUBLICATIONS

Leaenda Ingram, Hardanger Designs Collection www.leaendasewbiz.com.au, May 23, 2003.

(Continued)

*Primary Examiner*—Danny Worrell

(57) ABSTRACT

Hardanger embroidery designs, which can be performed by a sewing machine, preferably a computerized machine with digitized design embroidery patterns. The method employs a layer of fabric 11 and a layer of removable stabilizer 12. A wingneedle stitches square eyelet patterns reminiscent of hand-sewn hardanger. Sets of concentric underlay stitch lines 15 bind fabric 11 and removable stabilizer 12 about cutwork sections 16 before removing fabric from said cutwork sections. Sets of intersecting underlay stitch lines 18 replace bar threads in cutwork sections. Each set of intersecting underlay stitch lines 18 is anchored to sets of concentric underlay stitch lines 15 and associated fabric 11. Lace fill stitches 19 stitch onto removable stabilizer 12 in conjunction with intersecting underlay stitch lines. Lace fill stitches are anchored to either intersecting or concentric underlay stitch lines. Both concentric and underlay stitch lines are sewn in sets of at least two separate stitch lines in which each set of stitch lines are approximately parallel. The normal, cross-sectional distance across any set of underlay stitch lines is nearly as long as associated finishing stitches width. Finishing stitches 20 sew normal to, or otherwise cover, all sets of underlay stitch lines and associated cut fabric edges. Finishing stitch widths uniformly and sufficiently cover underlay stitch lines and fabric edges. Underlay stitch patterns 22 sew before and beneath hardanger motifs to locally bind fabric and removable stabilizer. Underlay stitch patterns permit scaling of hardanger motifs independent of fabric choice and emboss said hardanger motifs. Once a hardanger embroidery design is completed, removable stabilizer 12 is removed, leaving a hardanger embroidery design stitched to fabric.

20 Claims, 9 Drawing Sheets

U.S. PATENT DOCUMENTS 3,463,692 A * 8/1969 Brunner ..... 112/475.18
3,766,872 A * 10/1973 Krieger ..... 112/439
3,771,479 A 11/1973 Mavis
4,284,021 A 8/1981 Kaye
4,530,665 A 7/1985 Colonel
4,549,494 A 10/1985 Murphy
4,870,999 A 10/1989 Dennis
5,111,760 A 5/1992 Garzone
6,101,962 A 8/2000 Hinshaw
6,718,895 B1 4/2004 Fortuna

OTHER PUBLICATIONS

Karen McAuliffe, Hardanger 1 Collection www.designsinstitches.net, Nov. 4, 2002.
Jolyn Lloyd, Embroidery Techniques- Hardanger Mar. 12, 2003.

* cited by examiner

HARDANGER MACHINE EMBROIDERY AND METHOD

CROSS REFERENCE TO RELATED APPLICATIONS

This application is entitled to the benefit of Provision Patent Application Ser. No. 60/553,179, filed 2004 Mar. 15.

BACKGROUND OF THE INVENTION

This method relates to embroidery and more particularly to a method for performing hardanger embroidery with a sewing machine, which yields hardanger embroidery that looks like fine hardanger embroidery, performed by hand.

Traditional hardanger can be accomplished by hand stitching. Hand stitched hardanger embroidery involves stitching with needle and thread either parallel to the warp and weft of the fabric or at angles that follow the pores of the fabric. Hand stitched hardanger utilizes even weave fabrics with defined thread counts on the order of eighteen to thirty-two threads per inch, which are relatively coarse, loosely woven materials. The width of satin and other long finishing stitches in hand-sewn hardanger are inversely proportional to the thread count of the fabric used, such that higher thread counts fabrics yield hardanger stitches of shorter widths and, hence, produce smaller scaled embroidery designs. Fabric threads are counted with each stitch to create uniformity within the individual hardanger designs and symmetry with the whole hardanger design.

Hand-sewn hardanger employs a method of selective fabric removal in which sections of fabric are framed with kloster blocks, then selective threads are removed from the fabric framed by the same kloster blocks. The remaining bar or loose threads within the framed section of fabric create a lattice of intersecting threads with square voids in the fabric. These bar threads are then hand wrapped or woven with embroidery thread. Later, the sections of the hardanger design that comprise the fabric voids may be embellished with lace fill stitches for a decorative finish.

Additionally, hand-sewn hardanger employs a drawn thread method of creating eyelets in the fabric in which a square framed pattern of radial stitches are sewn and drawn tight to separate the threads of the fabric in order to create the eyelet hole.

Such hand stitching is very time consuming, often taking many days for each design. Thus, clothing and other fabric apparel containing hand stitched hardanger embroidery can be very time consuming to make and costly to buy. Additionally, the need to use low thread count even weave fabrics limits the scope of products on which hand stitched hardanger embroidery can be applied.

As a consequence people have tried to duplicate hand stitched hardanger embroidery using a sewing machine. Unfortunately, unlike manual stitching, a sewing machine cannot accurately place stitches based on fabric weave and pore position. Nor can a sewing machine dynamically alter the upper and lower thread tensions to achieve the pulled thread effect. Additionally, without the application of appropriate underlay stitches to most, if not all, of the satin and other long finishing stitches used in hardanger embroidery the fabric would tunnel when stitched with a sewing machine.

Thus, a need exist for a method for performing hardanger embroidery using a sewing machine that is equal to or better in appearance to hand stitched hardanger embroidery and yet can be performed in much less time and with a broader selection of fabrics and threads.

In prior art, two methods used to perform hardanger embroidery with an embroidery sewing machine reproduces long satin stitch patterns, but offers no solution for tunneling of fabric underneath said long satin stitches, nor do said methods address cutwork aspects or eyelet construction of traditional hand-sewn hardanger. The results produce kloster blocks and long satin stitch motifs in which fabric tunnels underneath stitching, regardless of fabric chosen. The overall result is undesirable and inferior to hand-sewn hardanger embroidery. Another method used to perform hardanger embroidery with an embroidery sewing machine addresses cutwork aspects and eyelet construction of hardanger embroidery. However, the method fails to properly address underlay stitch construction necessary for providing consistently stable and uniform satin stitches. The recreation of kloster blocks in outlining cut work sections of the hardanger embroidery proves inadequate, producing fabric tunneling beneath and excessive fraying of the cut fabric edges. Finally, eyelet construction fails to address a need for greater thread tension for results reminiscent of hand-sewn hardanger embroidery. The overall result is undesirable and inferior to hand-sewn hardanger embroidery.

U.S. Pat. No. 4,530,665 issued to Colonel on Jul. 23, 1985 teaches a method and an apparatus for embroidery, which uses a removable material. It does not use a sewing machine. U.S. Pat. No. 889,614 issued to Johnson on Jun. 2, 1908 teaches a method and an apparatus using a removable backing as an intermediate step in applying the embroidery, but the backing is removed prior to completing the embroidery. U.S. Pat. No. 823,421 issued to Loeb on Jun. 12, 1906, teaches a method and apparatus for stitching a decorative open thread work on fabric, but the cut fabric edges are finished by turning under the cut edge of the fabric and stitching in place. Said method does not use a conventional sewing machine. U.S. Pat. No. 1,203,561 issued to Aaron on Nov. 7, 1916 teaches a method of finishing the cut fabric edges by adding a folded binding. U.S. Pat. No. 924,795 issued to Klemm and Rorarius on Jun. 15, 1909, teaches a method of embossing an embroidery design by adding a backing fabric and padding materials. This method does not use a sewing machine. U.S. Pat. No. 4,870,999 issued to Dennis on Oct. 3, 1989, teaches a method of selectively removing threads from an even weave fabric and replacing them by weaving ribbon or yarn through remaining fabric threads. This method does not use a sewing machine. U.S. Pat. No. 385,772 issued to Owen on Jul. 10, 1888, teaches a method for removing selective threads from the fabric and creating a decorative, open pattern in the fabric. However, the threads must be removed by hand, singly. U.S. Pat. No. 5,111,760 issued to Garzone, May 12, 1992, teaches a method for creating lace on a soluble background using a method of double-embroidered lace in which each layer of lace is comprised of different types of thread, but is not like the present invention.

None of the prior art is like the present invention, which enables one to produce a hardanger embroidery effect that simulates or is even better than hand stitched hardanger embroidery.

The present invention provides such a method, which reduces substantially the time to produce a hardanger embroidery design, while greatly expanding the range of fabrics and threads that can be used to do so. For instance, a design that might take eight hours by hand stitching on a low thread count, open weave fabric, would take less than fifteen minutes, using a much wider variety of fabrics and threads, using the method taught by the present invention.

SUMMARY OF THE INVENTION

The primary object of the present invention is to provide a method of producing hardanger embroidery using a sewing machine (preferably one that is computerized and has digitizing software) which duplicates the appearance of hand stitched hardanger embroidery;

Another object is to provide such a method that yields hardanger embroidery having an even more enhanced, perfectly stitched appearance than hand stitched hardanger embroidery with less effort;

An additional object is to provide such a method, which expands the range of fabrics and threads that can be used to produce hardanger embroidery designs;

A further object is to provide such a method, which reduces the time necessary to produce hardanger embroidery designs;

A further object is to provide such a method, which produces a hardanger embroidery design in which the stabilizer layer is removable, producing embroidery with a cutwork section.

An even further object is to provide such hardanger embroidery using a sewing machine which yields an embossed appearance equal to or superior to hand stitched hardanger embroidery; and Still an even further object is to reduce the cost of clothing and other fabric articles having hardanger embroidery designs, by not employing hand stitches to do the labor.

The present invention accomplishes the above and other objects by providing a method for producing machine hardanger embroidery that simulates hand stitched hardanger embroidery by the use of two layers of material, one layer of fabric and a second layer of removable stabilizer. Examples of removable stabilizer material include, but are not limited to, water-soluble or heat-removable plastic, cloth or paperized fabric. My method requires that the stitching process begin by stitching the hardanger design onto both layers. The first components of the design that should be stitched are the eyelets, if any are part of the design. The eyelets should be sewn with a wingneedle following a square bracketed set of radial stitches as used with hand-sewn hardanger. The wingneedle separates the fabric in the center of the design, allowing the second half of the stitch to hold it open. The size of the wingneedle and the desired number of radial stitches used dictate the size of the eyelet pattern. Placing all wingneedle stitches at the beginning of the machine process, eliminates the need for an additional intermediate step of switching to a conventional embroidery needle.

Upon completing the eyelet stitches, if any, the next step in my method is to stitch, using a conventional sewing machine needle, a series of concentric underlay stitch lines, binding the fabric layer to the stabilizer layer immediately adjacent to the cutwork section of the hardanger design. The concentric underlay stitch lines should run approximately parallel to one another, should consist of no less than two lines, and should be far enough apart that the normal, cross-sectional distance from the inner line to the outer line is almost as long as the width of the finishing stitches that will eventually cover them.

Once the concentric underlay stitches are completed, the fabric layer within the inner most line of concentric underlay stitches is removed. The stabilizer layer is now kept in place with the concentric underlay stitches.

The next step in my method replaces the bar or loose threads that are part of hand-sewn hardanger embroidery with a series of intersecting underlay stitch lines sewn directly onto the stabilizer. The intersecting underlay stitch lines are sewn in a grid pattern in which the warp and weft stitches intersect with the concentric underlay stitch lines that secure the fabric to the stabilizer, anchoring the former stitches to the latter stitches and the associated fabric. Each bar of intersecting underlay stitches should consist of no less than two stitch lines, approximately parallel to one another, whose cross-sectional distance is almost as long as the width of the finishing stitches that will eventually cover them.

The next step in my method permits the embellishment of the fabric voids with lace fill stitches. When cutwork is applied, the lace fill stitches, which include an infinite variety of patterns, are stitched directly onto the stabilizer and underlay stitch lines. In my method, the lace fill stitches may be stitched immediately before, at the same time as, or immediately following application of the intersecting underlay stitch lines.

Following the completion of all underlay stitch lines and embellishment lace fill stitches, in my method the cut fabric edges and their associated concentric underlay stitches are covered with finishing stitches that are normal to, or otherwise cover, the aforementioned stitch lines in a manner that properly secures the finishing stitches to the underlay stitch lines and cut fabric edges. The finishing stitches simulate the kloster blocks used in hand-sewn hardanger embroidery. The intersecting underlay stitch lines used to replace the bar threads are also covered in finishing stitches that are normal to or otherwise cover the aforementioned stitch lines in a manner that properly secures the finishing stitches to the underlay stitch lines. In each case, the finishing stitch width is sufficiently wide enough to overcast the cross-sectional distance of one outer underlay stitch line to the other associate outer underlay stitch line or cut fabric edge.

Finally, in my method, where appropriate, motif stitch patterns, which include but are not limited to ships, hearts, stars and tulips, are sewn directly onto the fabric. However, my method requires that an appropriate underlay stitch pattern be applied within the stitch boundaries of each motif pattern, locally binding the fabric layer to the stabilizer layer, before the long finishing stitches of the motif stitch pattern are applied.

When the stabilizer has been removed by the appropriate method, as determined by the type of stabilizer used, the hardanger embroidery design is complete. No further trimming of fabric or threads is required.

The above and other projects, features and advantages of the present inventions should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
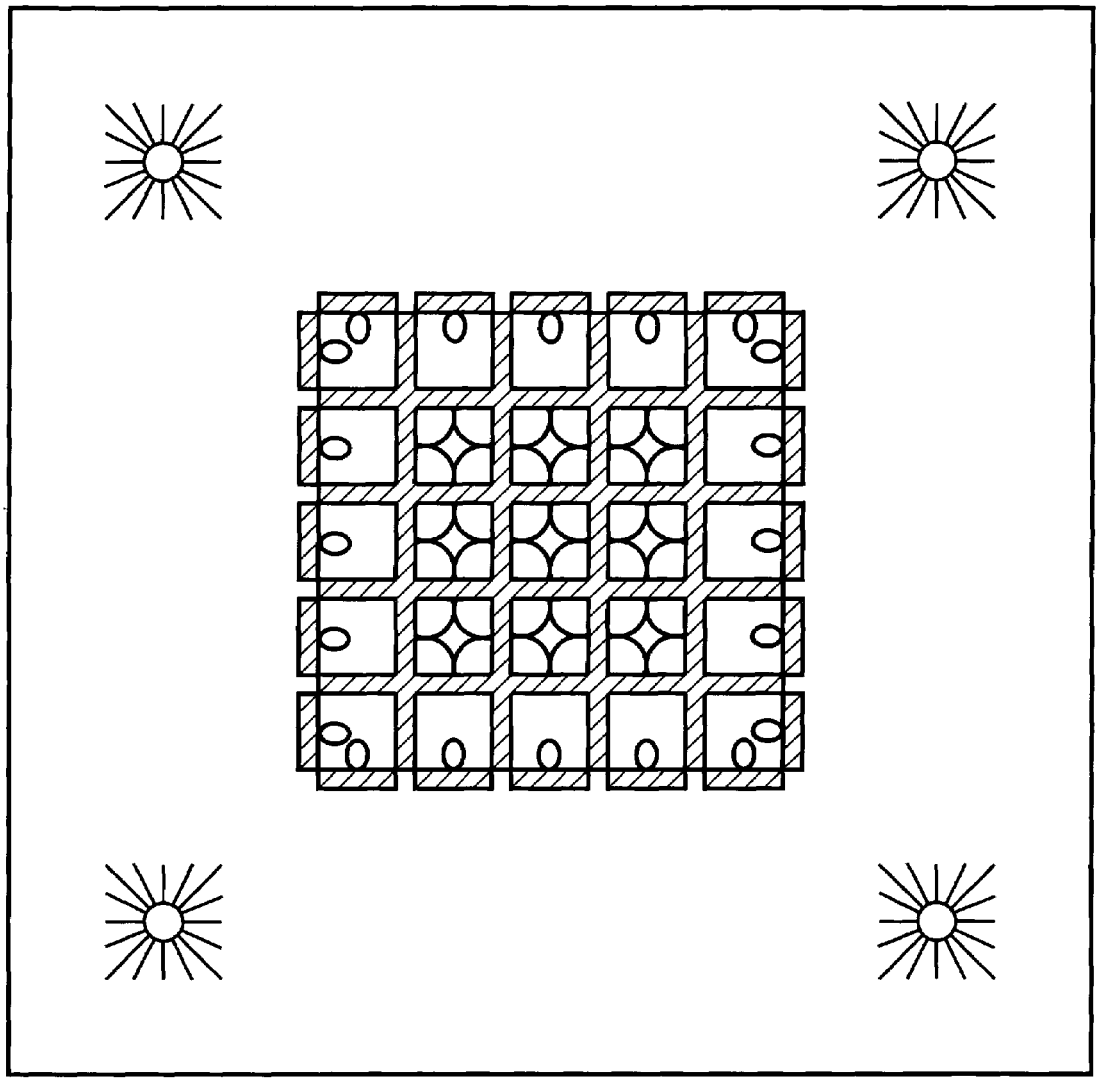
FIG. 1 is a front view of a hardanger embroidery design obtained by hand stitching.
Figure 2:
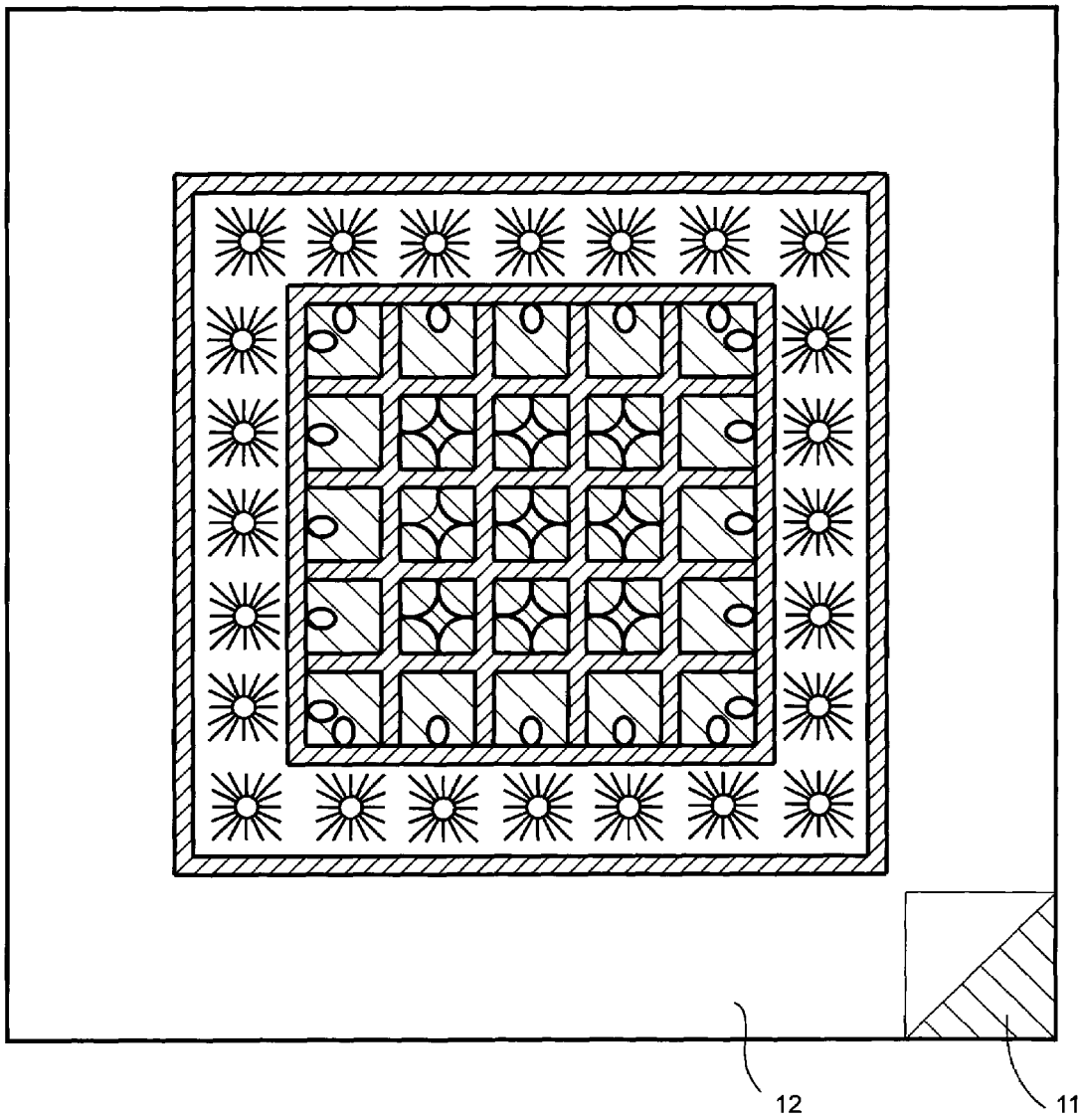
FIG. 2 is a front view of a hardanger embroidery design obtained by my method.

For purposes of describing the preferred embodiment, the terminology used in the reference to the numbered components in the drawing is as follows:

11. fabric
12. removable stabilizer
13. first stitch point in the hardanger embroidery eyelet stitch pattern
14. second stitch point in the hardanger embroidery eyelet stitch pattern
15. sets of concentric underlay stitch lines
16. cutwork section
17. fabric cut line
18. set of intersecting underlay stitch lines
19. lace fill stitches
20. finishing stitches
21. boundary outline of motif stitch pattern
22. underlay stitch patterns Referring now to the drawings, FIG. 1 shows traditional hardanger embroidery design performed by hand stitching, which uses only one layer of low thread count, even weave fabric. Achieving hardanger embroidery effect by hand stitching is accomplished by using a hand-stitching needle to stitch in place threads parallel to or at an angle to the warp and weft of the fabric. The stitches must be placed precisely based on the number of threads encompassed by each stitch in order to achieve the uniform geometry associated with hardanger embroidery. As a result the warp and weft threads must be counted with each stitch both with respect to the previous stitch, as well as, the other stitches throughout the balance of the embroidery pattern in order to maintain geometric uniformity.

As shown and describe in relation to FIGS. 2–8, the present invention uses at least two layers of material, a layer of fabric 11 that may be any fabric type and a layer of removable stabilizer 12. The hardanger embroidery design is stitched onto both layers, except where the cutwork effects are desired.

Figure 3:
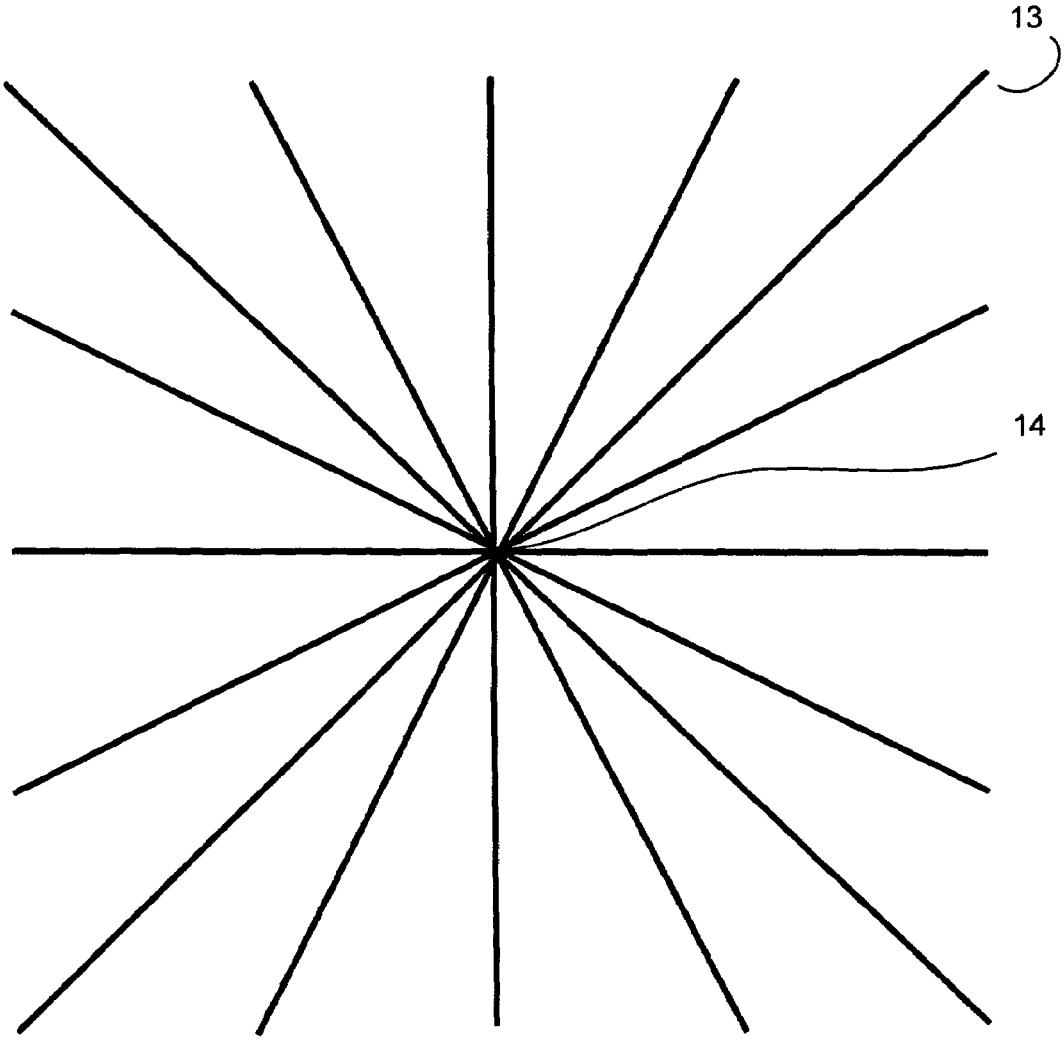
FIG. 3 is a square bracket arrangement of radial stitch lines used to define a hardanger embroidery eyelet.

FIG. 3 illustrates the stitch progression of each hardanger embroidery eyelet pattern. A wingneedle stitches first at a corner for a first stitch point 13 of an eyelet pattern, then through an associate center point of said eyelet pattern for the second stitch point 14. Then, a new stitch is begun in the radial stitch pattern where said wingneedle stitches to the outer edge of the pattern along another radial axis before returning to the center point of eyelet pattern to complete the stitch. This process is repeated until all radial stitches in the eyelet pattern are sewn and the wingneedle returns to the original first stitch 13 in the pattern.

The actual number of stitches required is dictated by thread weight, wingneedle size, overall size of eyelet pattern and desired effect to be achieved. When present in a hardanger embroidery design, hardanger embroidery eyelets are typically sewn first in my method in order to minimize changing stitching needle type. Secondarily, hardanger embroidery eyelet stitches, when present, bind fabric 11 to removable stabilizer 12 before any fabric 11 is removed for the cutwork section 16.

Figure 4:
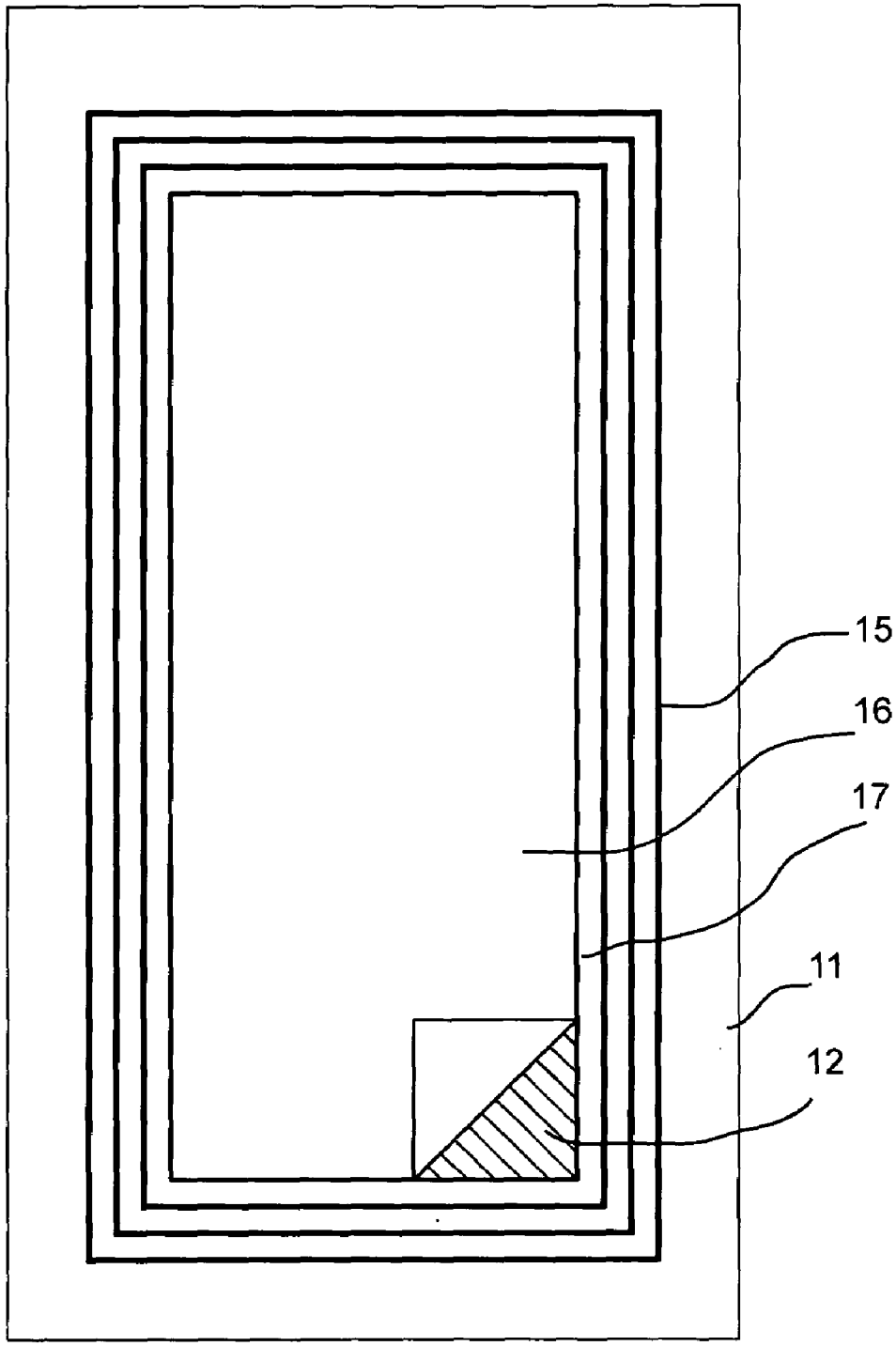
FIG. 4 is a top view fabric layer with concentric underlay stitch lines and representative cut line before fabric is removed.

FIG. 4 illustrates layout of a set of concentric underlay stitch lines with respect to a cutwork section 16 of this invention. Concentric underlay stitch lines 15 bind said fabric 11 to said removable stabilizer 12, immediately adjacent to said cutwork section 16. Next, said fabric 11 of said cutwork section is removed just inside the inner most concentric underlay stitch line, as illustrated by a dotted fabric cut line 17, leaving intact said stabilizer beneath said cutwork section. Sets of concentric underlay stitch lines 15 shall consist of no less than two separate stitch lines and each said line shall be sewn approximately parallel to the other said line. Furthermore, a normal, cross-sectional distance between outer most concentric underlay stitch lines 15 within a set shall be nearly as long as the width of the finishing stitches 20 that eventually cover said set of concentric underlay stitch lines.

Figure 5:
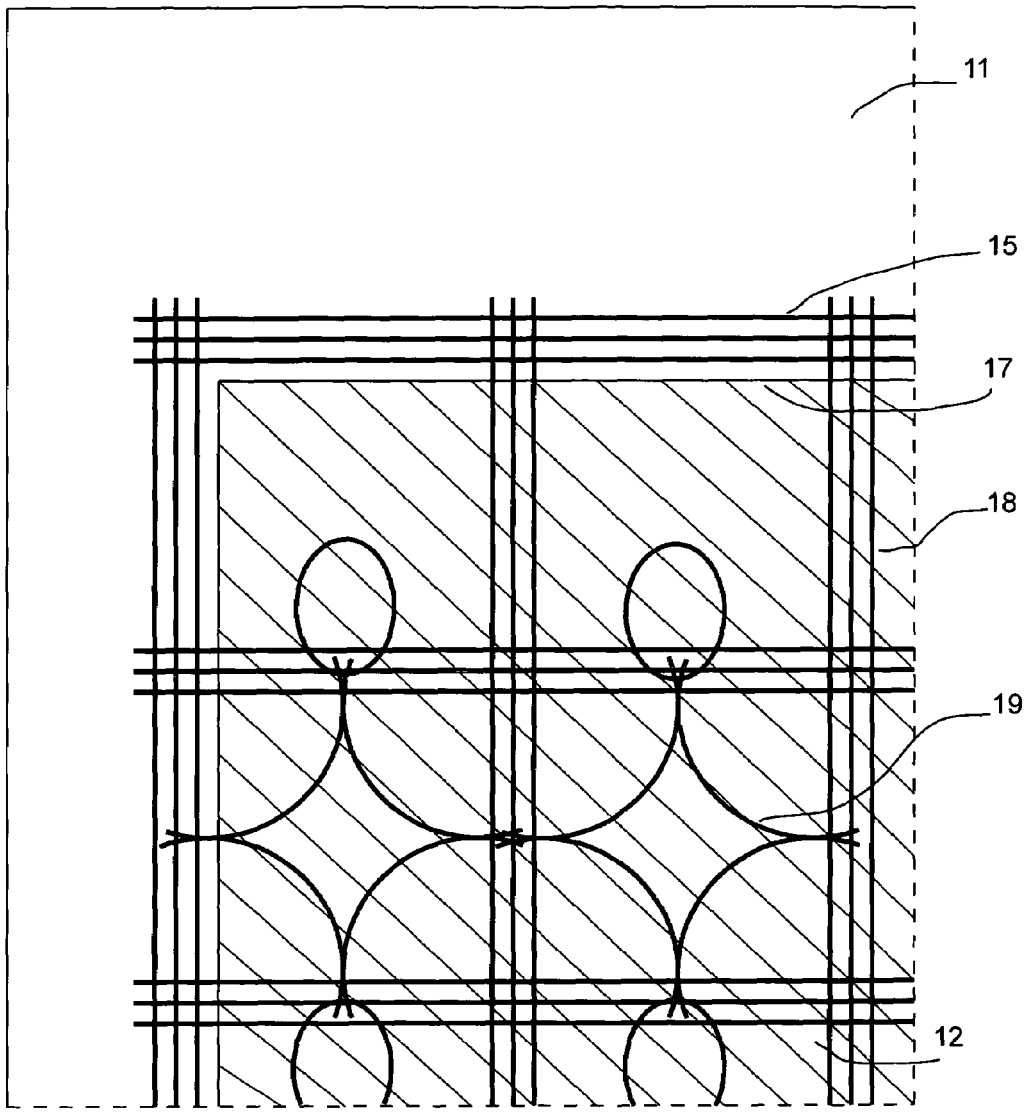
FIG. 5 is a top view of intersecting underlay stitch lines machine sewn onto the cutwork section of the design.

FIG. 5 illustrates layout of sets of intersecting underlay stitch lines 18 and associate lace fill stitches 19 with respect to sets of concentric underlay stitch lines 15 and cutwork section of my invention. Said sets of intersecting underlay stitch lines 18 are sewn at normal angles to each other and said concentric underlay stitch lines 15. Said sets of intersecting underlay stitch lines 18 are stitched directly onto said removable stabilizer 12, where said fabric has been removed from said cutwork sections. Said sets of intersecting underlay stitch lines 18 also intersect with said sets of concentric underlay stitch lines 15 on each end of sets of intersecting underlay stitch lines, anchoring the former to the latter and to said fabric 11. Said sets of intersecting underlay stitch lines 18 substitute for bar threads and should be sewn in groups of no less than two stitch lines per bar threads section and each said stitch line in said set should be stitched approximately parallel to the other said stitch line in said set. Furthermore, normal cross-sectional distance between the outer most stitch lines in said set of intersecting underlay stitch lines 18 should be approximately as long as the width of finishing stitches 20 that will eventually cover said sets of intersecting underlay stitch lines.

Also illustrated in FIG. 5 are lace fill stitches 19, which in this invention are applied immediately before, during, or immediately following application of said sets of intersecting underlay stitch lines 18. Said lace fill stitches 19 are stitched directly onto said removable stabilizer. Additionally, said lace fill stitches are also stitched on said sets of concentric or intersecting underlay stitch lines, anchoring said lace fill stitches to said sets of concentric or underlay stitch lines.

Figure 6:
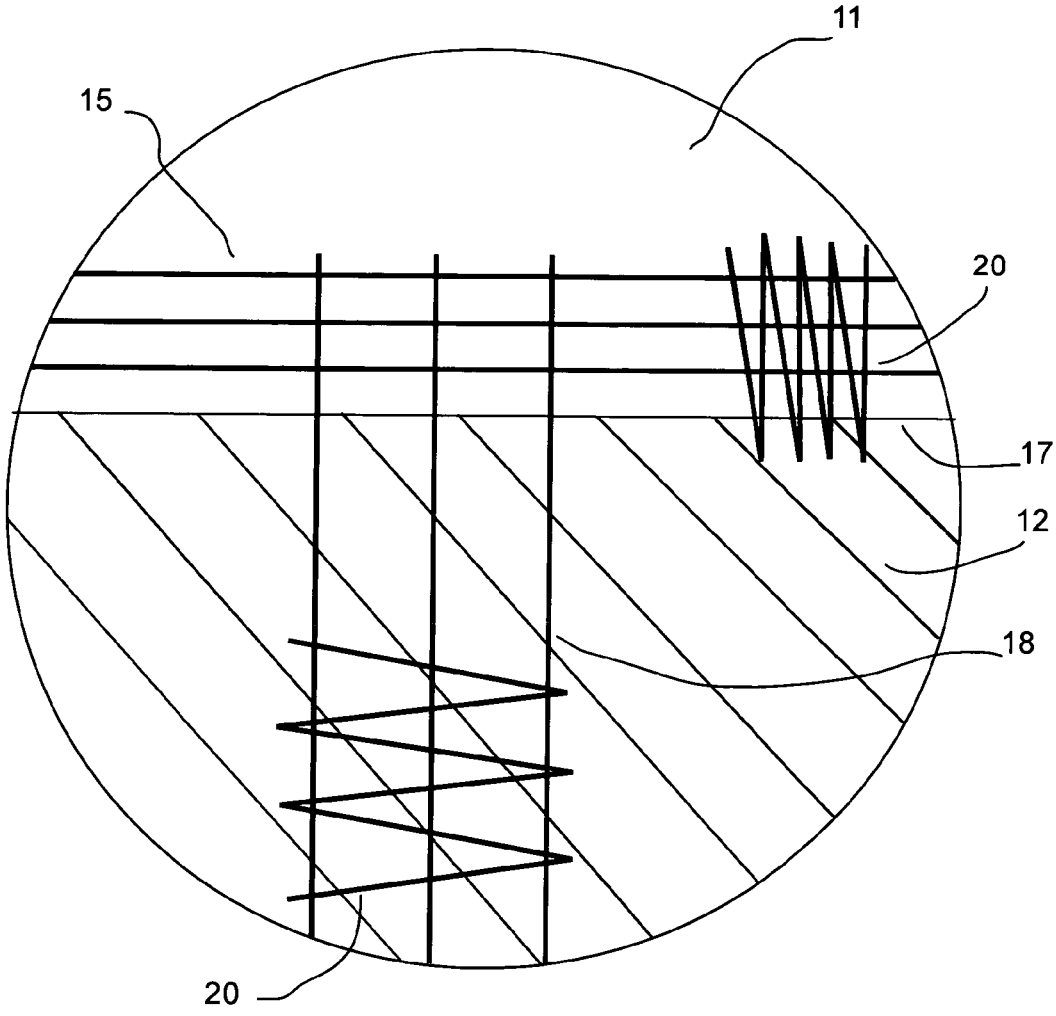
FIG. 6 is a close up view of the finishing stitches covering the concentric underlay stitch lines, associated cut fabric edges, and intersecting underlay stitch lines.

FIG. 6 illustrates use of finishing stitches 20 to cover all sets of concentric and intersecting underlay stitch lines 15 and 18 and associated fabric cut lines 17. Width of said finishing stitches 20 should be sufficient to completely overcast all said sets of concentric and intersecting underlay stitch lines and, where appropriate, said fabric cut lines 17. Said finishing stitches 20 should be approximately normal to, or otherwise cover, said sets of concentric and intersecting stitch lines in a manner that properly secures the said finishing stitches 20 to said sets of concentric and underlay stitch lines and said cut fabric lines. Stitch density of said finishing stitches is dictated by thread weight and desired coverage.

Figure 7:
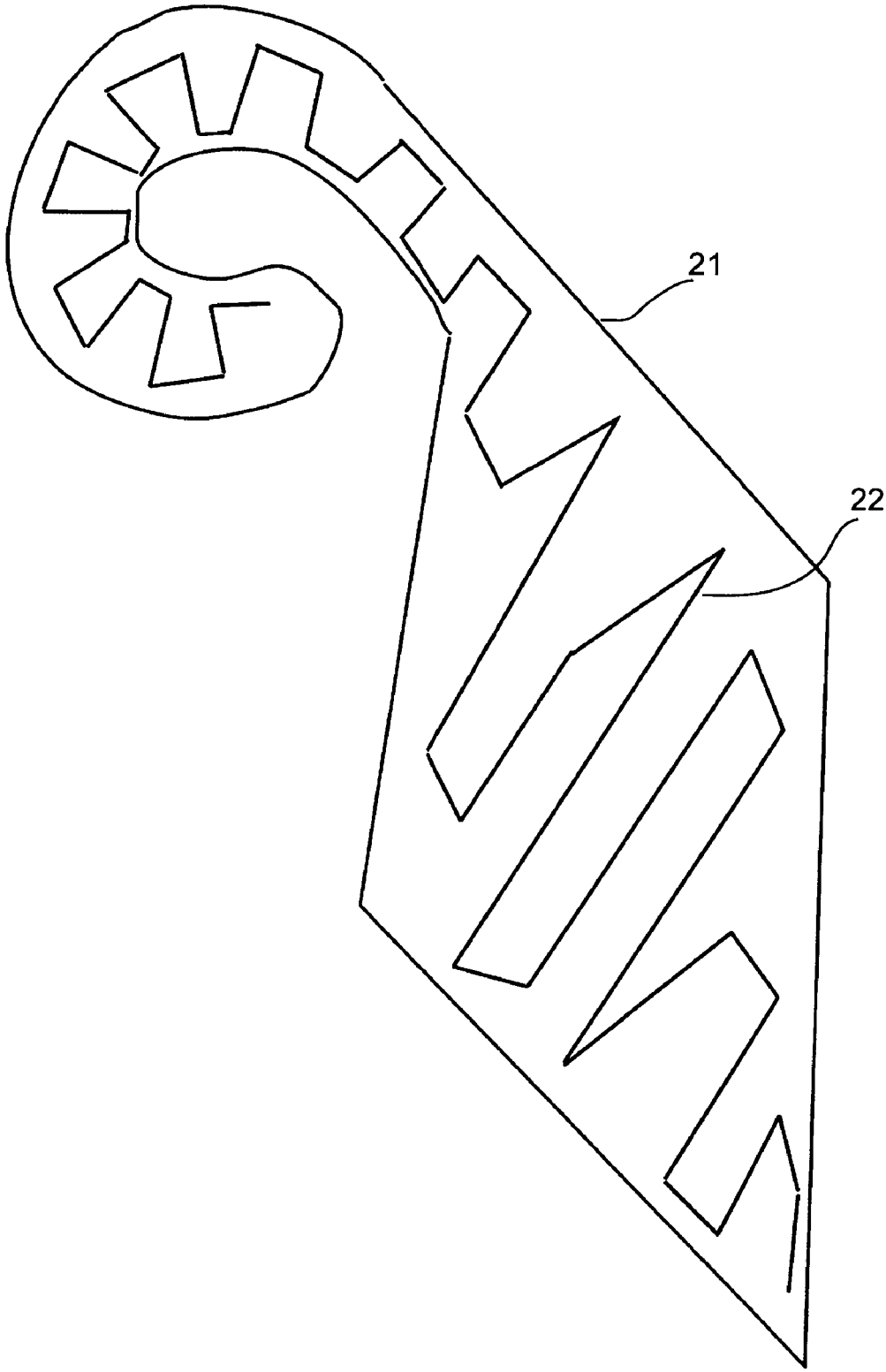
FIG. 7 is a close up view of a motif stitch pattern outline with requisite underlay stitch lines.

FIG. 7 illustrates use of underlay stitches applied beneath hardanger embroidery motifs. My invention requires a set of appropriate underlay stitch patterns 22 be applied within a stitch boundary outline 21 of each hardanger motif pattern, locally binding said fabric layer to said stabilizer layer, before finishing stitches of said hardanger embroidery motif are applied FIG. 8 illustrates application of said finishing stitches 20 over top of and covering said set of appropriate underlay stitch patterns 22 in said hardanger embroidery motif.

Figure 8:
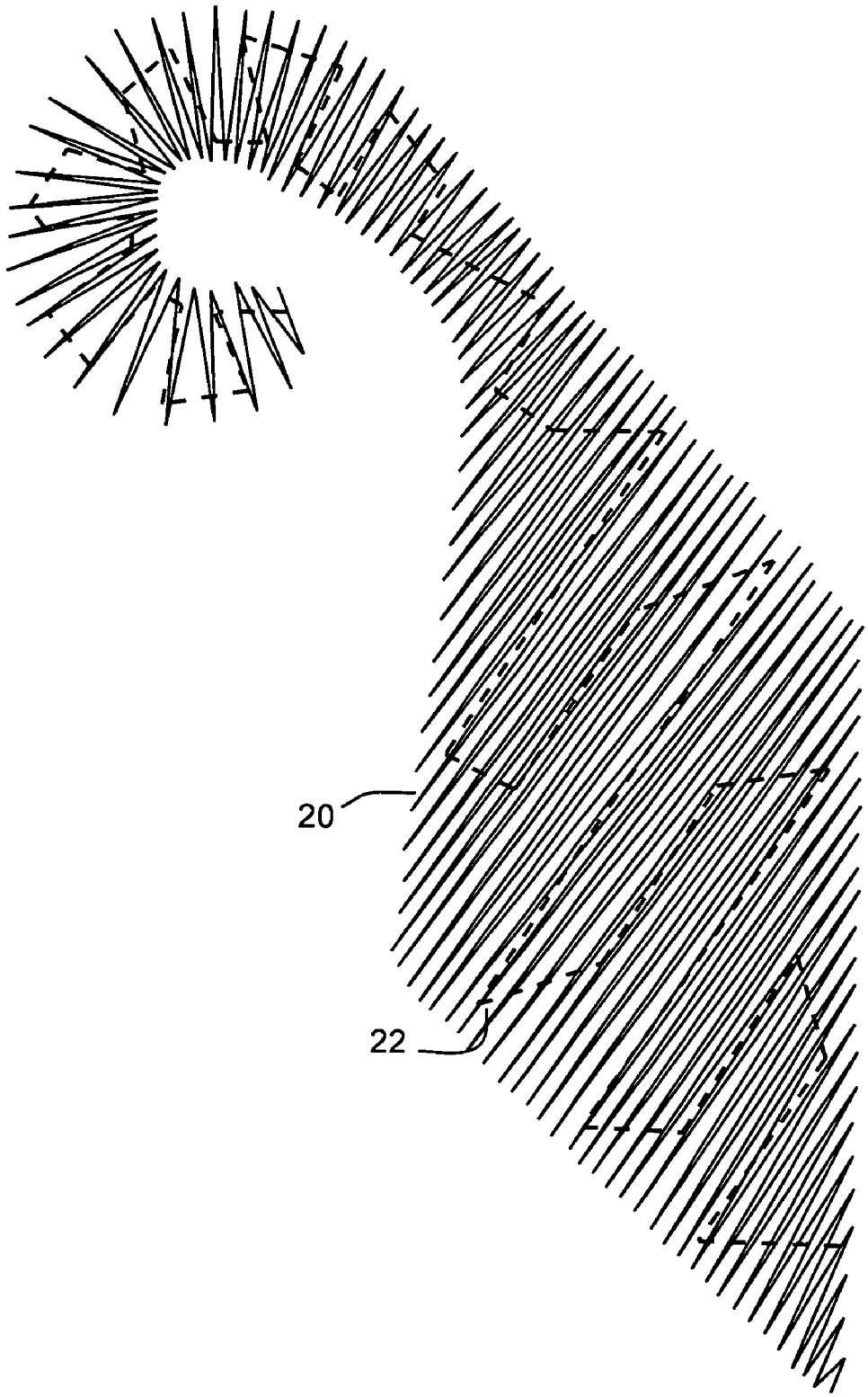
FIG. 8 is a close up, semi-transparent view of a motif stitch pattern in which the finish stitches have covered the underlay stitch lines.

In FIGS. 7 and 8, the method in my invention should be applied to each hardanger embroidery motif included in the overall hardanger embroidery design.

When all stitching is finished, said removable stabilizer 12 may be removed in an appropriate manner as recommended by the manufacturer of the same.

DESCRIPTION OF ALTERNATIVE EMBODIMENTS

Figure 9:
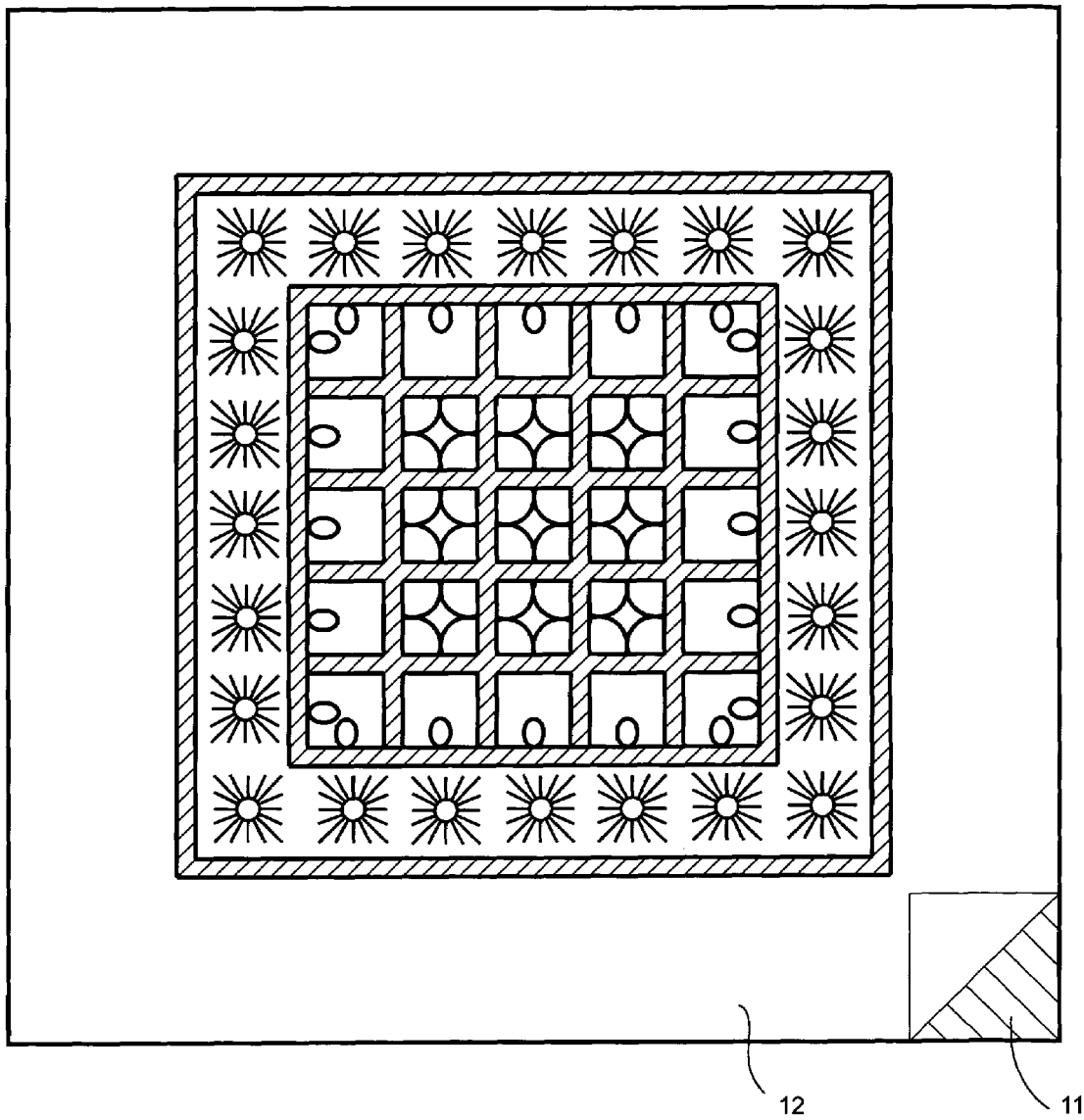
FIG. 9 is a top view of an alternative embodiment of hardanger embroidery with a sewing machine in which the fabric of the cutwork section is not removed.

With FIG. 4, a cutwork section 16 of fabric is removed before a set of intersecting underlay stitch lines 18 and lace fill stitches 19 are applied in FIG. 5. However, removal of said fabric is not a prerequisite to sewing said intersecting underlay stitch lines and said lace fills stitches. Said fabric may be left in place and said intersecting underlay stitch lines and said lace fill stitches may be stitched directly onto said fabric as illustrated in FIG. 9.

Moreover, should said fabric from said cutwork section 16 be left in tact, other appropriate hardanger embroidery stitch patterns may be substituted for said sets of intersecting underlay stitch lines 18 and said lace fill stitches 19.

The use of my method in conjunction with a sewing machine significantly reduces the time to produce hardanger embroidery designs from as much as several days for hand sewing to as little as fifteen minutes, particularly if the pattern has been digitized on a computer and a computerized embroidery sewing machine with fabric-holding hoop, which is readily available commercially, is used. Moreover, using this invention not only saves time, but also reduces the high cost of producing hardanger embroidery designs. As a result, clothes and other fabric articles having hardanger embroidery designs made with my invention are more affordable and more readily available to consumers, thereby promoting hardanger embroidery to a wider audience.

While only a few embodiments of the present invention have been described in detail hereinabove, all improvements and modifications to this invention within the scope of equivalents of the claim are covered by this invention. Some improvements include but are not limited to:

Using the same thread in the top and bobbin of a sewing machine to produce a finished look on both sides of a hardanger embroidery design;

Changing thread color in the sewing machine at specific points in a design to create a contemporary look to said design; and, Incorporating cross-stitch embroidery with a sewing machine into the design as resembles traditional, hand-sewn hardanger embroidery.

I claim:

1. A method for producing hardanger embroidery using a sewing machine which simulates hand stitched hardanger embroidery, comprising the steps of:

Stitching onto at least one layer of fabric and one layer of removable stabilizer, Stitching a set of hardanger embroidery eyelet stitches with wingneedle Stitching a set of concentric underlay stitch lines, whereby said concentric underlay stitch lines define a cutwork section in a hardanger embroidery design, Removing from each said cutwork section a section of fabric, whereby inner most stitch lines of corresponding said sets of concentric underlay stitch lines are used as a cut line guide for said cutwork sections, Stitching sets of intersecting underlay stitch lines, whereby each said set of intersecting underlay stitch lines intersects approximately normal to other said sets of intersecting underlay stitch lines and said sets of concentric underlay stitch lines, Stitching lace fill stitches directly onto said removable stabilizer, said concentric underlay stitch lines, and said intersecting underlay stitch lines, whereby a portion of said lace fill stitches are anchored to the hardanger embroidery by way of said concentric and underlay stitch lines and a portion of said lace fill stitches are eventually left free-standing within voids between sets of intersecting underlay stitch lines, upon removal of said removable stabilizer, Stitching finishing stitches over all said concentric underlay stitches, said intersecting underlay stitch lines, and said cut fabric edges, whereby said finishing stitches cover said concentric underlay stitches, said intersecting underlay stitch lines, and associated cut fabric edges, Stitching a set of appropriate underlay stitch patterns within the outline of each hardanger motif design, whereby said fabric is locally anchored to said removable stabilizer before applying finishing stitches with which to complete each hardanger motif design, Stitching said finishing stitches over top of said appropriate underlay stitch patterns, whereby said finishing stitches complete each said hardanger motif design.

2. The method of claim 1 further comprises the step of stitching all concentric and intersecting underlay stitch lines in sets consisting of at least two separate stitch lines.

3. The method of claim 2 further comprises the step of stitching each said stitch line in each said set of concentric or intersecting underlay stitch lines approximately parallel.

4. The method of claim 2 further comprises the step of stitching each said set of concentric or intersecting underlay stitch lines such that the normal, cross-sectional distance between the outer most stitch lines in each said set of concentric or intersecting underlay stitch lines is approximately as long as the desired width of said finishing stitches.

5. The method of claim 1 further comprises the step of stitching lace fill stitches immediately before, during, or immediately following the application of said sets of intersecting underlay stitch lines.

6. The method of claim 5 wherein said lace fill stitches are sewn partially onto said sets of concentric underlay stitch lines or said sets of intersecting underlay stitches, whereby said lace fill stitches are anchored to a hardanger embroidery design by way of said sets of concentric and underlay stitch lines.

7. The method of claim 5 wherein removal of said removable stabilizer leaves a portion of said lace fill stitches free-standing within said voids of said fabric.

8. The method of claim 1 further comprises the step of covering all said concentric and intersecting underlay stitch lines and all fabric cut lines with finishing stitches.

9. The method of claim 8 wherein the width of said finishing stitches is no wider than is adequate to span the cross-sectional distance between two outer underlay stitch lines in said set of concentric or intersecting underlay stitch lines or an outer underlay stitch line and an opposite fabric cut line in any said set of concentric or intersecting underlay stitch lines.

10. The method of claim 8 wherein said finishing stitches are sewn approximately normal to, or otherwise cover, said set of concentric or intersecting stitch lines, whereby said finishing stitches are adequately secured to said set of concentric or intersecting underlay stitch lines to minimize lateral movement of said finishing stitches along said set of concentric or intersecting underlay stitch lines.

11. The method of claim 10 herein said finishing stitches overcast said cut fabric edges, whereby said finishing stitches minimize fraying and enhance integrity along entire length of all said cut fabric edges.

12. The method of claim 1 further comprises the step of stitching said set of appropriate underlay stitch patterns to bind said fabric to said removable stabilizer before stitching the hardanger motif designs.

13. The method of claim 12 herein said underlay stitch patterns applied beneath said hardanger embroidery motifs emboss said hardanger motif designs.

14. The method of claim 12 herein said set of appropriate underlay stitch patterns permit scaling of said motif without consideration of type of said fabric on which said hardanger embroidery motif is stitched.

15. The method of claim 1 further comprises the step of removing the stabilizer material.

16. The method of claim 15 wherein the stabilizer material is removed by heat.

17. The method of claim 15 wherein the stabilizer material is removed by water.

18. The method of claim 1 further comprises the step of providing more uniform stitches than hand-sewn hardanger because of the use of the sewing machine, thereby maintain constant thread tension throughout the stitching process.

19. The method of claim 1 further comprises a structure of underlay stitches and a means of machine stitching said hardanger embroidery design on a wider range of fabrics than hand stitched hardanger.

20. The method of claim 1 further comprises a structure of underlay stitches and a means of machine stitching said hardanger embroidery design with a wider range of range of embroidery threads than hand stitched hardanger embroider.

* * * * *